US006007173A

United States Patent [19]

DeLouise et al.

[11] Patent Number: 6,007,173

[45] **Date of Patent: *Dec. 28, 1999**

[54] INK STATUS SYSTEM FOR A LIQUID INK PRINTER

[75] Inventors: Lisa A. DeLouise, Rochester; Sophie V. Vandebroek, Penfield; Joel A. Kubby, Rochester, all of N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/721,515

[22] Filed: Sep. 26, 1996

[51] Int. Cl.[6] ..... B41J 2/195

[52] U.S. Cl. ..... 347/7

[58] Field of Search ..... 347/7, 85–87; 73/304 R, 304 C

[56] References Cited

U.S. PATENT DOCUMENTS

| | | | |
|---|---|---|---|
| 3,921,035 | 11/1975 | Holmes | 315/307 |
| 4,342,042 | 7/1982 | Cruz-Uribe et al. | 346/140 R |
| 4,415,886 | 11/1983 | Kyogoku et al. | 340/618 |
| 4,700,754 | 10/1987 | Kringe | 141/95 |
| 5,049,898 | 9/1991 | Arthur et al. | 346/1.1 |
| 5,136,305 | 8/1992 | Ims | 346/1.1 |
| 5,289,211 | 2/1994 | Morandotti et al. | 346/140 R |
| 5,386,224 | 1/1995 | Deur et al. | 347/7 |
| 5,583,544 | 12/1996 | Stamer et al. | 347/7 |

*Primary Examiner*—John Barlow
*Assistant Examiner*—Craig A. Hallacher

[57] ABSTRACT

An ink status system for determining the status of a consumable supply of ink contained in an ink container. The ink status system includes a first conductor, disposed on a first wall of the ink container, being aligned with the first wall such that the consumable supply of ink contacts a decreasing portion of the first conductor during consumption thereof and an ink sensing circuit, coupled to the first conductor, generating a continuously variable ink level signal as a function of the decreasing portion of the first conductor being contacted by the consumable supply of ink during consumption thereof. The ink status system is used in a liquid ink printer to determine the amount of ink remaining in an ink tank or ink cartridge. A liquid ink printhead of the printer includes the necessary circuitry to generate a signal indicating the status of the ink which can include ink levels as well as ink types or colors.

19 Claims, 6 Drawing Sheets

INK STATUS SYSTEM FOR A LIQUID INK PRINTER

FIELD OF THE INVENTION

This invention relates generally to a liquid ink printer and more particularly to an ink status system including ink level sensing and/or ink type sensing for a liquid ink printer.

BACKGROUND OF THE INVENTION

An ink jet printer of the so-called drop on demand type has at least one printhead from which droplets of ink are directed towards a recording medium. Within the printhead the ink is contained in a plurality of channels in which energy pulses are used to cause the droplets of ink to be expelled, as required, from orifices or nozzles at the end of the channels.

In a thermal ink-jet printer, the energy pulses are usually produced by resistors, each located in a respective one of the channels and individually addressable by current pulses to heat and vaporize ink in the channels. A thermal energy generator, usually a resistor, is located in each of the channels, a predetermined distance from the nozzles. The resistors are individually addressed with a current pulse to momentarily vaporize the ink thereby forming a bubble which expels an ink droplet. As the bubble grows, the ink which bulges from the nozzles is contained by the surface tension of the ink as a meniscus. As the bubble begins to collapse, the ink remaining in the channel between the nozzle and the bubble moves towards the collapsing bubble, causing a volumetric contraction of the ink at the nozzle resulting in the separation of the bulging ink as a droplet. The acceleration of the ink out of the nozzle while the bubble is growing provides the momentum and velocity of the droplet in a substantially straight line direction towards the recording medium. Because the droplet of ink is emitted only when the resistor is actuated, this type of thermal ink jet printing is known as drop-on-demand printing. The channel is then refilled by capillary action which, in turn, draws ink from a supply container. Operation of a thermal ink jet printer is described in, for example, U.S. Pat. No. 4,849,774.

One particular form of thermal ink jet printer is described in U.S. Pat. No. 4,638,337. The described printer is of the carriage type and has a plurality of printheads each having its own ink supply cartridge mounted on a reciprocating carriage. The nozzles in each printhead are aligned perpendicularly to the line of movement of the carriage and a swath of information is printed on the stationary recording medium as the carriage is moved in one direction. The recording medium is then stepped perpendicularly to the line of carriage movement by a distance equal to the width of the printed swath. The carriage is then moved in the reverse direction to print another swath of information. Full width or page width linear arrays, in which the sheet is moved past a linear array of nozzles extending across the full width of the sheet, are also known.

The ink supply cartridge is typically a prepackaged, usually disposable item, having a sealed container holding a supply of ink and having attached thereto a printhead with a linear or matrix array of nozzles. The printhead is either permanently attached to the cartridge, in which case, the entire printhead/cartridge is disposed of, or the cartridge is without a permanent printhead, in which case, the cartridge is disposed of by itself. Generally, the printhead includes terminals to interface with an electronic controller of the printer; electronic parts in the printhead itself are associated with the ink channels in the printhead, such as the resistors and any electronic temperature sensors, as well as digital means for converting incoming signals for imagewise operation of the heaters. Typically, cartridges are purchased as needed by the consumer and used either until the supply of ink is exhausted or until the amount of ink in the cartridge becomes insufficient to maintain the back pressure of the ink to the printhead within the usable range.

While many liquid ink printers have no mechanism to determine the amount of ink remaining within an ink supply, it is desirable to provide an indicator or signal to a user indicating that the supply of ink has been exhausted or has been sufficiently depleted such that continued printing will provide unsatisfactory results. Known ink level sensing systems include providing an indication that the end of the ink supply has been reached, counting the number of ink droplets the printhead is instructed to print, and providing discrete levels of ink level sensing.

Various ink quantity or level sensing systems for determining the amount of ink remaining in an ink supply are illustrated and described in the following disclosures, which may be relevant to certain aspects of the present invention.

In U.S. Pat. No. 4,342,042 to Cruz-Uribe et al., an ink supply system for an ink jet printer including a primary ink supply source and a secondary ink supply reservoir is described. The secondary ink supply reservoir includes a thin flexible membrane which serves as the upper surface and expands or contracts depending upon the amount of ink present in the reservoir. A proximity device senses the movement of the flexible membrane to monitor the quantity of ink present in the reservoir.

U.S. Pat. No. 5,049,898 to Arthur et al., describes a disposable printing assembly including a memory element in which data characterizing the assembly can be stored. The data can characterize the identity of the assembly or one or more of its operational characteristics. A monitoring circuit counts the number of ink droplets the printhead is instructed to print. This count is related to the quantity of ink consumed by the printhead during a given printing task. The memory element on the printhead desirably has a datum thereon that indicates the relative quantity of ink remaining in the ink chamber.

U.S. Pat. No. 5,136,305 to Ims, describes an ink jet printer with ink supply monitoring means. The printer includes a replenishable ink cartridge and ink jet printhead mounted on a carriage for translation across a printing region. The replenishable ink cartridge contains an ink supply monitoring means using a thermistor and constant current circuitry to indicate when the cartridge should be resupplied with ink.

U.S. Pat. No. 5,289,211 to Morandotti et al., describes an ink detecting device which gives advance warning of the end of the ink in a reservoir or cartridge feeding an ink jet thermal printhead. A pair of electrodes that are emersed in a spongy, ink soaked body contained in the reservoir, are arranged in a region adjacent to a feed duct at which the spongy body has a higher capillarity than in remote regions. The electrodes are connected to a bridge circuit which measures the electrical resistance of the ink between the two electrodes.

U.S. Pat. No. 5,386,224 to Deur et al., describes a discrete ink level sensing system including a level sensing probe with at least first and second level sensing pads placed in an ink reservoir. The level sensing system uses electrical conductivity of the ink to detect when the upper surface level of the ink is lower than the lowest points of the level sensing pads.

SUMMARY OF THE INVENTION

In accordance with one aspect of the present invention, there is provided an ink status system for determining the status of a consumable supply of ink contained in an ink container. The ink status system includes a first conductor, disposed on a first wall of the ink container, being aligned with the first wall such that the consumable supply of ink contacts a decreasing portion of the first conductor during consumption of the supply of ink and an ink sensing circuit, coupled to the first conductor, generating a continuously variable ink level signal as a function of the decreasing portion of the first conductor being contacted by the consumable supply of ink during consumption thereof.

Pursuant to another aspect of the present invention, there is provided a liquid ink printer including an ink container having a first wall, adapted to hold a consumable supply of ink, a first conductor disposed on the first wall of the ink container, being aligned with the first wall such that the consumable supply of ink contacts a decreasing portion of the first conductor during consumption thereof, an ink sensing circuit, coupled to the first conductor, generating a continuously variable ink level signal as a function of the decreasing portion of the first conductor being contacted by the consumable supply of ink during consumption thereof, and a printhead, coupled to the ink container, depositing ink received from the ink container.

According to an additional aspect of the present invention, there is provided an ink level system for determining levels of a consumable supply of ink contained in an ink container. The ink level system includes a first conductor disposed in a first wall of the ink container, a plurality of conductors disposed on a second wall of the ink container and an ink sensing circuit coupled to the first conductor and to the plurality of conductors generating an ink level signal as a function of the consumable supply of ink.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
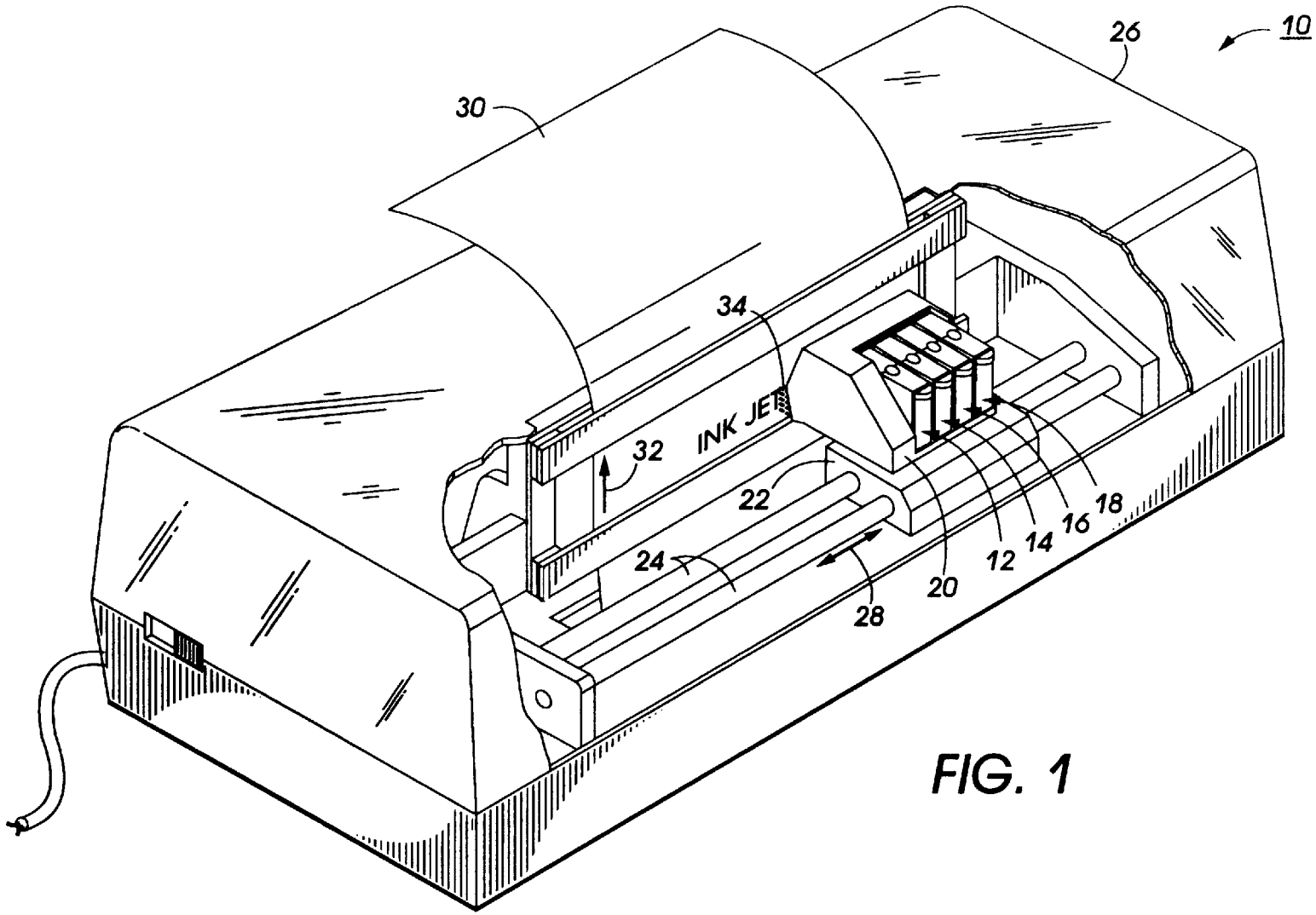
FIG. 1 illustrates a perspective view of a color ink jet printer incorporating the ink status system of the present invention.

FIG. 1 illustrates a perspective view of a color thermal ink jet printer 10 which incorporates an ink status system of the present invention. While an ink jet printer 10 is illustrated, other liquid ink printers are also within the scope of the invention. Printer 10 includes four ink jet printhead cartridges 12, 14, 16, and 18 detachably mounted in a housing 20 attached to a carriage 22 supported by carriage rails 24. The carriage rails 24 are supported by a frame 26 of the ink jet printer 10. The carriage 20 moves in a scanning direction 28 reciprocating across a recording medium 30, such as a sheet of paper, which is advanced in a direction 32 for printing. Each printhead cartridge includes an ink container containing ink for supply to a thermal ink jet printhead which selectively expels droplets of ink under control of electrical signals received from a controller (not shown) of the printer 10 through an electrical cable (not shown).

As the carriage 22 reciprocates back and forth across the recording medium 30, droplets of ink are expelled from selected ones of a plurality of printhead nozzles of a printhead 34. The nozzles, also known as ink ejecting orifices, are typically arranged in a linear array substantially perpendicular to the scanning direction 28. During each pass of the carriage 22, the recording medium 30 is held in a stationary position. At the end of each pass, however, the recording medium is stepped by a stepping mechanism under control of the printer controller in the direction of the arrow 32. For a more detailed explanation of the printhead and printing thereby refer to U.S. Pat. No. 4,571,599 and U.S. Pat. No. Reissue 32,572, the relevant portions of which are incorporated by reference.

Each of the printhead cartridges 12, 14, 16, and 18, can be coupled to the printhead 34 such that a portion or segment of the linear array of nozzles is associated with each of the color cartridges. It is also, however, possible that each of the printhead cartridges 12, 14, 16, and 18 can be individually coupled to a single printhead such that each printhead deposits ink on the recording medium 30 of a single color such as cyan, magenta, yellow or black under control of the controller.

It is well known and common place to program and execute imaging, printing, document, and/or paper handling control functions and logic with software instructions for conventional or general purpose microprocessors or controllers. This is taught by various prior patents and commercial products. Such programming or software may, of course, vary on the particular functions, software type and microprocessor or other computer system utilized but will be available to or readily programmable without undue experimentation from functional descriptions such as those provided herein, or prior knowledge of functions which are conventional, together with general knowledge in the software or computer arts, that can include object oriented software development environments such as C++. Alternatively, the disclosed system or method may be implemented partially or fully in hardware, using standard logic circuits or a single chip using VLSI designs.

Figure 2:
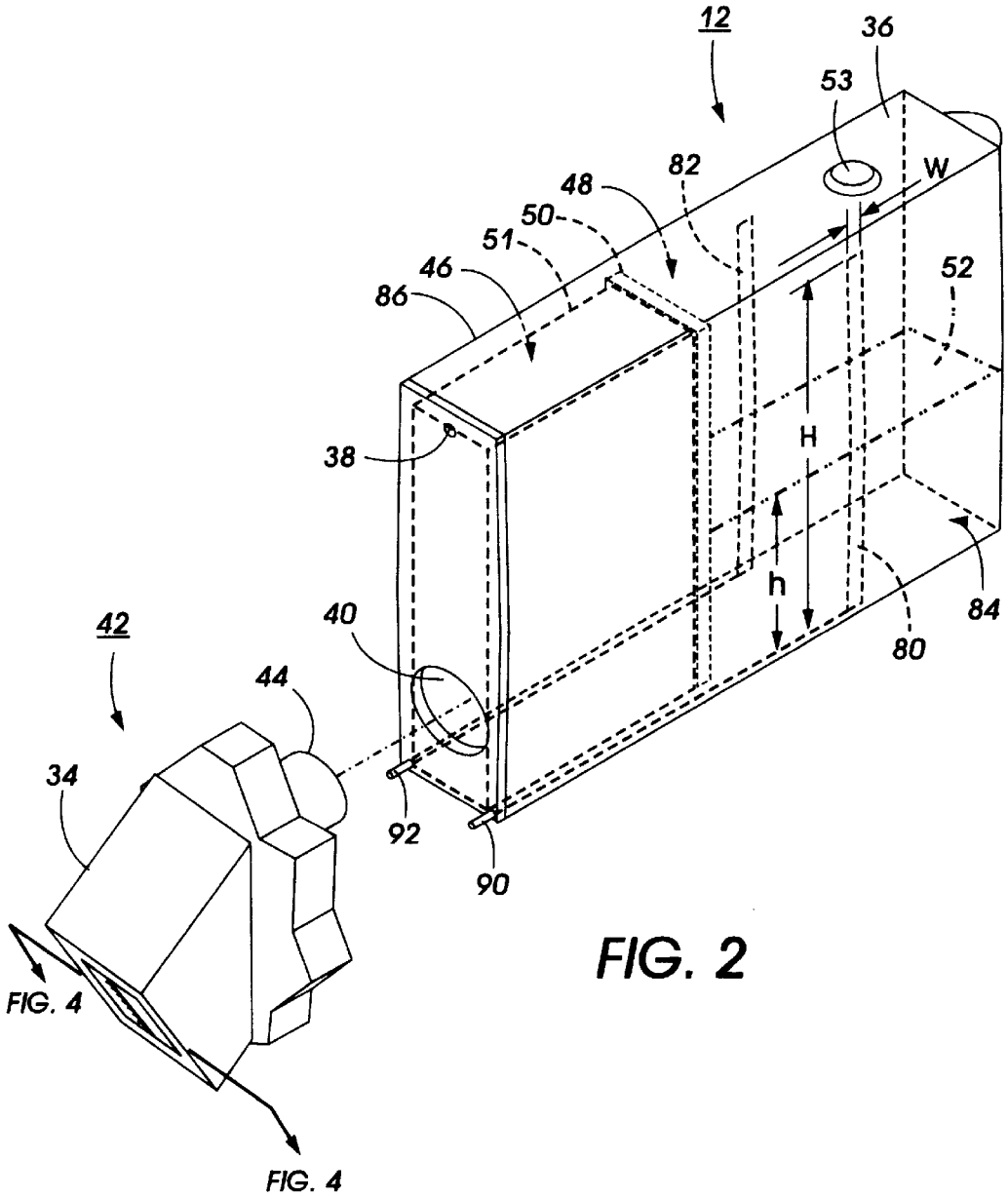
FIG. 2 illustrates a schematic perspective view of an ink supply cartridge including an ink jet printhead and an exploded view of an ink manifold.

FIG. 2 illustrates the ink cartridge 12 which is substantially identical to the remaining ink cartridges 14, 16, and 18. The ink cartridge 12 includes a housing 36, formed of polypropylene for instance, having an air inlet 38 and an outlet port 40. The outlet port 40 receives a manifold member 42 having an ink pipe 44 which is inserted into the outlet port 40 for receiving ink. The manifold 42 is coupled to the printhead 34 for delivery of ink thereto. The housing 36, also includes, a first chamber 46 and a second chamber 48 defined by the housing 36 and a dividing member 50. The first chamber 46 includes an ink impregnated foam member 51 being contacted by the end of the ink pipe 44. The second chamber 48 includes a consumable supply of liquid ink 52 which flows into the first chamber 46 upon demand according to the ink being ejected by the printhead 34. A fill hole 53 provides for the filling of the housing 36 with ink.

As ink is consumed by ejection through the printhead 34, the amount of ink within the second chamber 48 decreases such that the top surface of the ink falls from an upper portion to a lower portion of the chamber 48. While it may be apparent to a user when the amount of ink remaining within the chamber 48 is insufficient to complete a printing operation, the ability to sense the presence and/or the amount or level of ink within the second chamber 48 is desirable since running out of ink during printing of a document wastes time, effort, ink and paper. Ink status sensing is especially useful in multiple reservoir color printers, where one color is often predominantly used. While some ink level sensors rely on using optical sensor concepts to determine the amount of ink within a chamber or ink cartridge, such optical sensors must rely on the optical clarity of the reservoir or chamber material being used. Consequently, when optical sensing concepts to detect ink levels within a chamber are used, the material properties of the chamber must be strictly controlled with respect to the need for optical sensing and other reservoir properties such as chemical robustness ultrasonic weldability and flame retardability cannot always be optimized. Therefore, it is desirable to directly sense the ink within the chamber and not to rely on any intermediary such as the cartridge itself.

The present invention includes directly sensing ink conductivity where electrical current is passed directly through the ink. Any system or sensor passing current through ink must be carefully designed to avoid the destructive influences resulting therefrom. It has been found that when a potential difference is applied across any electrodes immersed in a conductive solution, such as ink, current is carried by electrons in the external circuit and by ions in the solution. Electrochemical reactions take place in the solution as electrons are lost (oxidation) at an anode and gained (reduction) at a cathode.

Current passed through ink induces electrochemical changes. Therefore, it has been found that a practical sensor should minimize any electrochemical change by maintaining an extremely low current over the operational lifetime of the ink cartridge. Assuming that a $1\times10^{-6}$ mole compositional change (0.096 coulombs) can be tolerated over a one year lifetime ($3.15\times10^{7}$ seconds), then a sensor circuit must operate with a current of less than or equal to $3.1\times10^{-9}$ amps assuming that a simple transistor circuit, such as illustrated in FIG. 3 is used.

Figure 3:
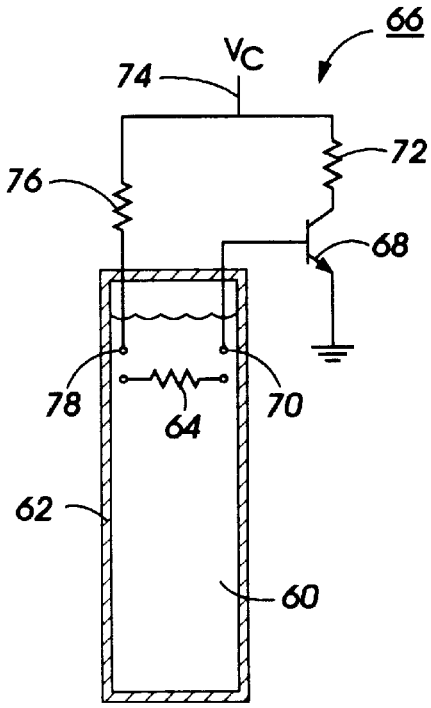
FIG. 3 illustrates a simplified circuit diagram including a vertical bipolar junction transistor for sensing ink.

As schematically illustrated in FIG. 3, a volume of ink 60 contained within a container 62 can be considered to have an effective ink resistivity here illustrated as a resistor 64. An ink sensing circuit 66 which includes an NPN transistor 68 having the base thereof connected to a first conductor 70 immersed in the ink and the collector thereof coupled through a resistor 72 tied to a voltage supply 74. The voltage supply is also connected to a resistor 76 having an end coupled to a second conductor 78 also immersed in the ink 60. Using the previously stated assumptions, the base current of such a circuit must be less than or equal to $3.1\times10^{-9}$ amps.

For reliable sensor operation with such small base currents, high gain bipolar transistors should be used. Based on the high conductivity of currently used ink formulations, maintaining such a base current in the nanoamp range would require prohibitively large on chip transistor base resistance of approximately 1,000 meg-ohms. While this resistance is currently deemed to be too high, it has been found that a feasible on chip base resistance of approximately 100 K will limit the base current to approximately less than or equal to 50 micro-amps. Using such a sensor including this base current continuously over a one year period would still generate less than approximately 20 millimols of electrons, which has been found to be acceptable. It is also possible, however, that the sensor need not operate in a DC mode continuously. The ink level could be observed only during a power up cycle, or in the alternative, AC sensing could be implemented which would significantly limit the electrochemical degradation. In this case, even higher currents could be passed through the ink solution.

While the effective resistance $R_L^{eff}$ of the ink, as embodied by the resistor 64, of FIG. 3, can theoretically be considered as equivalent to the ink conductivity between the points 70 and 78, in reality, this resistance is dependent on both any sensor electrode dimensions as well as the ink conductivity. As illustrated in FIG. 2, the present invention includes a first conductor 80 and a second conductor 82 disposed on the inner surfaces of opposite side walls 84 and 86. The first conductor 80 and the second conductor 82 are exposed conductors in contact with the ink contained within the second chamber 48. As the ink is consumed, the ink contacts a decreasing portion of each of the conductors such that an increasing portion of the conductors are exposed to air within the chamber 48. As can be seen, the first conductor 80 and the second conductor 82 are aligned with the side walls such that the axis of each of the conductors is substantially perpendicular to the level of the ink as it moves down the chamber walls. Other configurations are also possible as long as the ink contacts a decreasing portion of at least one of the conductors.

Using this configuration of electrodes, the effective resistance of resistance 64 of FIG. 3 can be estimated according to the following equations:

$$R_L^{eff}=S_e(A_e*K)$$

$$A_e=W*h$$

where K is the ink conductivity, $S_e$ is the electrode spacing, $A_e$ is the electrode area, W is the electrode width, and H is the electrode height and h is length of the electrode covered by ink. Using the electrode configuration illustrated in FIG. 2, $S_e$ is equal to 2 cm, where $S_e$ is equal to the distance between the opposite inner surface of side walls 84 and 86, W is equal to 50 micrometers and H is equal to 3 cm. This electrode configuration can be implemented by attaching an adhesive film with a single exposed conductive strip on the opposite interior walls of the chamber 48. Other electrode implementations are also possible, including laser fusing graphitic fibers impregnated into the cartridge material as described in U.S. Pat. No. 5,462,773 to Swift et al., assigned to Xerox Corporation.

The first conductor 80 and the second conductor 82 are respectively coupled to a first connector 90 and a second connector 92 for connection to an ink status sensing circuit to be described herein. As an example, using this electrode configuration with two different ink conductivities $2\times10^{-2}$ $(\text{ohm-cm})^{-1}$ and $2\times10^{-3}$ $(\text{ohm-cm})^{-1}$, it has been found that in the instance of the first ink conductivity the effective resistance varies from 7 K ohms when the ink level is full to 53 K ohms when the ink level is ⅛th full and to infinity when empty. For the second ink conductivity, the effective ink resistance varies from 67 K ohms when full to 533 K ohms when ⅛th full and, of course, infinity when empty. While the values of effective ink resistance from ink levels of full to ink levels of empty are not substantially linear, the values of the effective ink resistance do change predictably, and the present invention can be used to not only detect discrete levels of ink but can also be used to effectively generate a signal or indicator which varies continuously according to the amount of ink contained within the cartridge. It is important to note that the electrical circuit specifications can be tailored to ink conductivities and electrode configurations.

Figure 4:
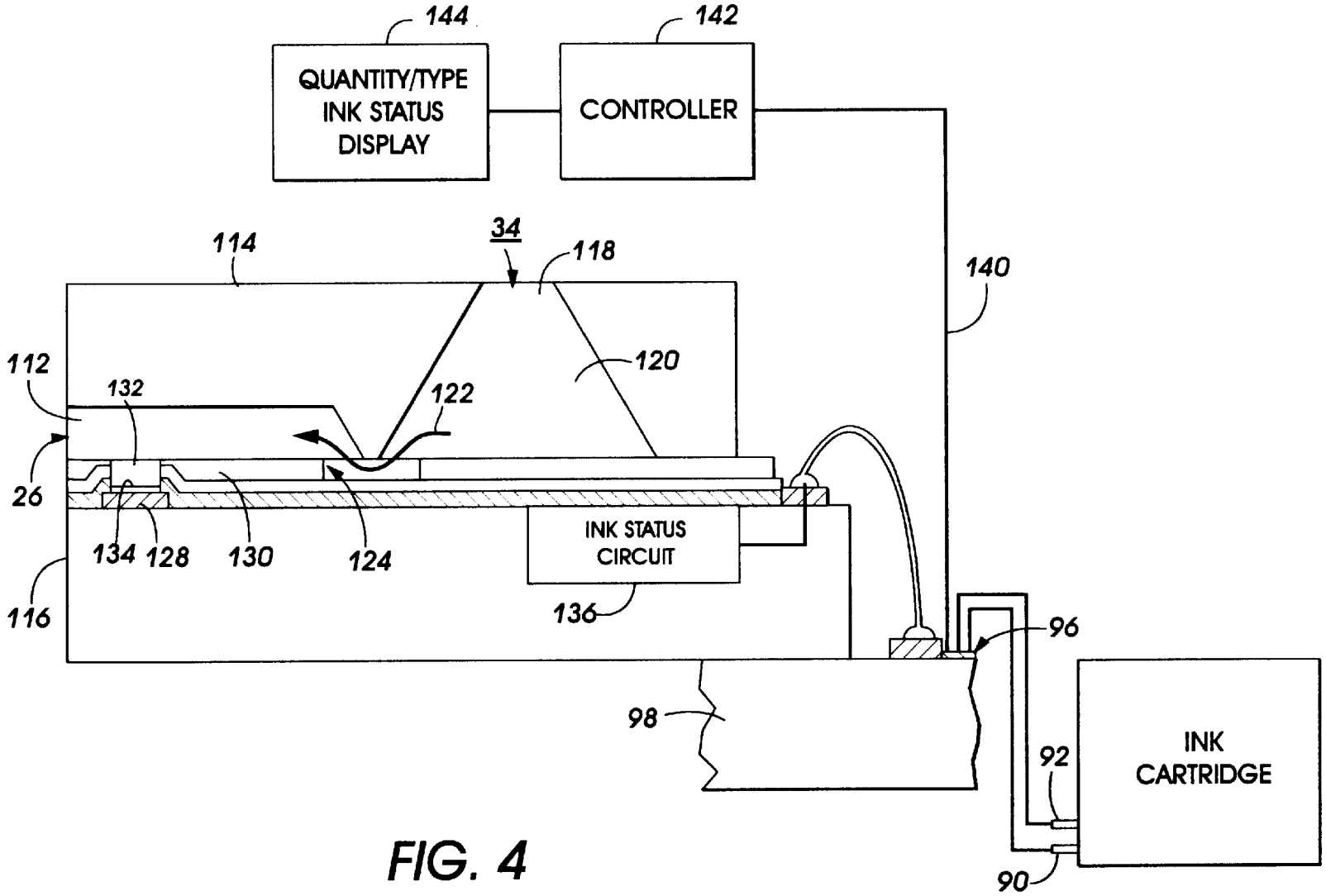
FIG. 4 illustrates an ink status system of the present invention including an ink status circuit disposed on the ink jet printhead illustrated as a sectional side view.

In a preferred embodiment of the present invention as illustrated in FIG. 4, the first connector 90 and the second connector 92 are coupled to separate connectors 96 disposed on a supporting substrate 98 supporting the ink jet printhead 34. The ink jet printhead includes a channel 112 defined by a channel plate 114, typically made of silicon, in combination with a heater plate 116 also typically made of silicon. The channel plate includes an ink feed port 118 through which ink enters into a chamber 120 and which travels along the path 122 through a recess 124 and out through a ink ejecting orifice or nozzle 126. Ink is ejected from the channel 112 by application of an energy pulse to a transducer or heater 128 defined in the substrate 116 which is recessed from a top surface of a protective layer 130 and disposed in a pit 132. Typically, the heater 128 is also covered by a protective layer 134 to reduce or prevent harmful effects of the ink during ejection thereof.

The ink jet printhead 134 also includes an ink status circuit 136 as well as other known driving and selecting circuitry for addressing each of the heaters in the printhead. The ink status circuit 136 is coupled to the first conductor 90 and the second conductor 92 through wire bonding from the substrate 116 to the supporting member 98. The ink status circuit 136, generically described as circuit 66 of FIG. 3, generates a signal indicating ink status over a conductor 140 which is coupled to a printer controller 142. The printer controller 142 processes the signal transmitted over the conductor 140 and processes the signal for subsequent display on a quantity/type ink status display 144. The ink status display can be either single or multiple indicator displays such as lights or gauges or preferably the output of a cathode ray tube or flat panel display of a computer terminal from which printing is being controlled.

Figure 5:
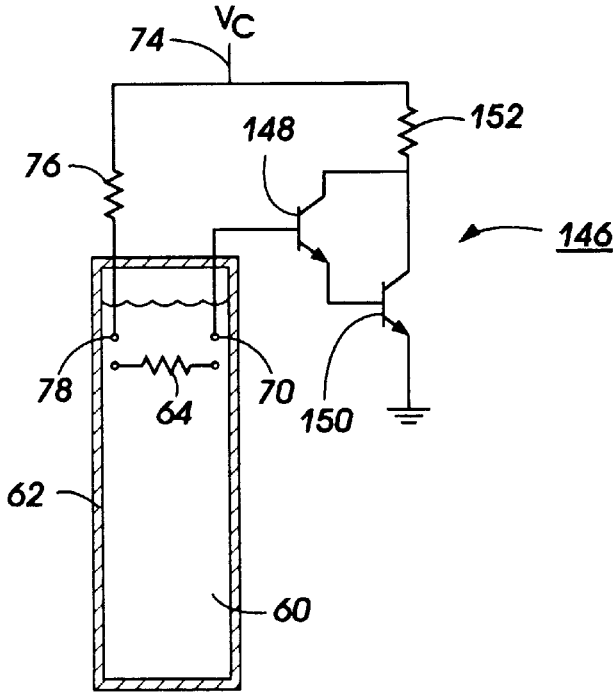
FIG. 5 illustrates a simplified circuit diagram including a Darlington pair bipolar junction transistor circuit for sensing ink.

FIG. 5 illustrates a high gain Darlington pair configuration 146 including a first NPN transistor 148 and a second NPN transistor 150 arranged in the known Darlington pair configuration. This circuit provides a high gain which is the product of the individual transistor gains which has been found sufficient for use in the present invention. By varying the value of a collector resistor 152, the circuit 146 will operate as an ink presence sensor that detects for the presence of ink when the resistor 152 is a large value and operates as an ink level sensor when the resistance value 152 is small.

Figure 6:
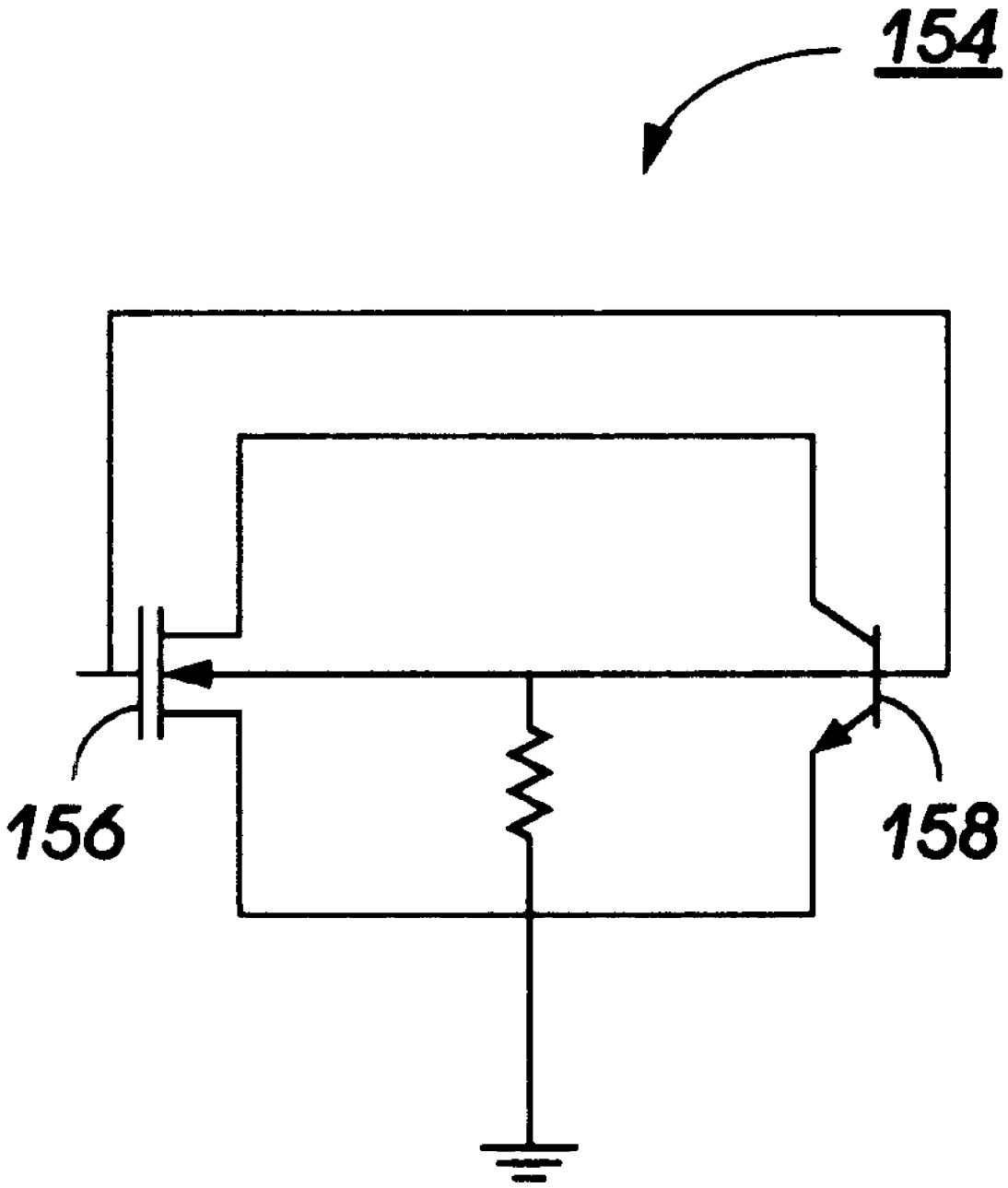
FIG. 6 illustrates an equivalent circuit of a hybrid-mode bipolar junction transistor included in the ink status circuit of FIG. 4.

Because the ink status circuit 136 is being incorporated directly on the integrated circuit chip, the type of technology used to process the chip dictates what type of transistors can be used in the ink status circuit. In a CMOS architecture, in which N- and P- isolation mask levels are used, the fabrication of conventional high grain vertical or lateral bipolar junction transistors are possible. Optimum bipolar junction transistor device characteristics can be designed into the CMOS process to tailor specific sensor circuit characteristics as is understood by those skilled in the art. If the printhead architecture, however, is fabricated according to n-MOS processes, a direct on-chip electronic ink level status circuit is possible by employing a hybrid mode lateral bipolar junction transistor circuit 154 as illustrated in FIG. 6. This device is essentially a MOSFET 156 in which the gate and the substrate are internally tied together to form the base of a lateral bipolar junction transistor 158. At low collector current levels, this device has a gain of greater than 1,000. This hybrid-mode high gain lateral bipolar junction transistor is fully compatible with advanced CMOS technology. Fabrication of such a device is described in "High-Gain Lateral Bipolar Action in a MOSFET Structure", Verdonckt-Vandebroek et al., IEEE transactions On Electron Devices, Volume 38, No. 11, November, 1991, herein incorporated by reference.

While the present invention can be operated as a simple off/on switch that is sensitive to the presence of ink above or below a preset level, the present invention can also be used to continuously detect ink level transduced from the dependence of an analog output voltage which is generated by the described ink sensing circuits which are dependent upon the effective ink resistivity. In addition, because of the sensitivity of the present invention to ink conductivity, it is also possible to use the present invention to determine ink types such as inks of different colors since it is known that different colors of inks can have different ink conductivities. Since inks of different colors can be distinguished, the present invention could sense for the proper use of colored inks and could provide a signal disabling printer function or flagging a warranty violation if inks which are not approved are used in the present invention.

Figure 7:
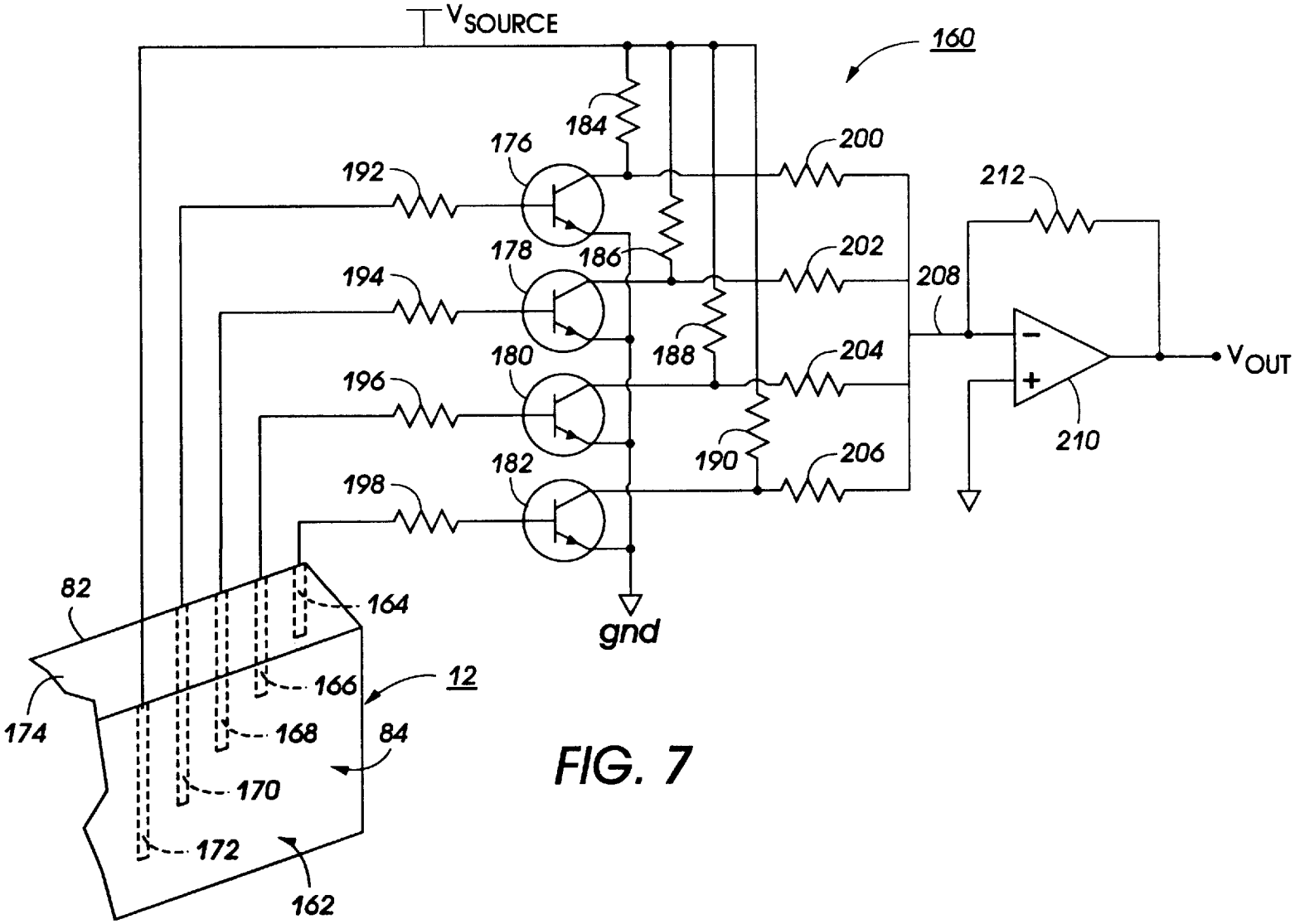
FIG. 7 illustrates a segmented electrode ink level sensing circuit of the present invention.

FIG. 7 illustrates a discrete ink level sensing circuit 160 including a discrete ink level sensor 162 disposed on interior surfaces of opposite side walls 82 and 84 of the ink cartridge 12 here shown in a partial schematic view. The discrete ink level sensor includes a plurality of ink level sensors or conductors 164, 166, 168 and 170. The illustrated segmented electrode design or segmented conductor design senses discrete levels of ink or other conductive fluids within the cartridge 12. As illustrated, the conductors 164, 166, 168, and 170, are disposed on the interior surface of the wall 82 and the conductor 172 is disposed on the other interior surface of the side wall 84. In addition, each of the conductors 164, 166, 168, 170, and 172 includes a different length which is measured from a top wall 174 to a respective end of each of the individual conductors. It is also possible, however, that the conductor need not begin at the top wall 174 but begin at some point therebeneath. In addition, the conductors 164, 166, 168, 170 and 172 can be disposed on the same side wall or in any other combinations.

The discrete ink level status circuit 160 includes a summing circuit including a plurality of NPN transistors 176, 178, 180, and 182 having a voltage source coupled to the collector of each of the transistors through a plurality of associated resistors 184, 186, 188, and 190. The emitters of each of the transistors are tied to ground. The discrete ink level sensor 162 generates an output which is fed to the summing circuit through a plurality of resistors 192, 194, 196 and 198 each of which is coupled between one of the conductors and an associated NPN transistor as illustrated. The conductor 172 is coupled to the voltage source.

The segmented electrode design does not sense changes in ink conductivity due to lowering ink levels as previously described, but instead detects discrete levels or ranges of ink when ink is present between different electrodes of the ink level sensor, so long as the liquid or ink has a minimal conductivity sufficient to conduct current. Since the conductor 172 is tied to the voltage source and the remaining conductors 164, 166, 168, and 170 are each tied to different of the NPN transistors each through an associated base resistor, a current flows between each of the conductors 164, 166, 168, and 170 and the conductor 172 as long as the ink is contacting at least a portion of each of the conductors 164, 166, 168, and 170. For instance, when the ink cartridge 12 is full of ink, each of the conductors will be immersed in ink such that current flows between the conductor 172 and each of the remaining conductors thereby turning on each of the transistors to develop a voltage at the collectors thereof. When each of the transistors is turned on, the output at the collector at each of the NPN transistors can be considered to be equivalent to the voltage source dropped through an associated one of the plurality of resistors 184, 186, 188, and 190. These voltage sources are then summed through an associated plurality of resistors 200, 202, 204 and 206 each of which is tied to a common conductor 208 and input to the negative input of a summing amplifier 210 using negative feedback through a resistor 212. The output of the amplifier, $V_{out}$ is sensed by the controller 142 of FIG. 4 and generates in response thereof a signal indicating how much ink remains in the ink cartridge.

If, for instance, the amount of ink is depleted such that the top surface of the ink or ink level is below the conductor 164 but still contacts the conductor 166, then it can be seen that the transistors 176, 178, and 180 are turned on such that the value at $V_{out}$ is approximately equal to three times the voltage source indicating that the ink cartridge is three quarters full. Once the ink level drops below the conductor 166, but still is in contact with the conductors 168 and 170, the transistors 176 and 178 are turned on such that the value of $V_{out}$ is equal to approximately two times the voltage source indicating that the ink cartridge is one-half full. As can now be seen, once the ink level drops below the conductor 168 but still is in contact with the conductor 170, the value at $V_{out}$ will be one times the value of the voltage source indicating that the tank is one quarter full. Of course, when the ink level drops below the conductor 170 none of the transistors are turned on, the value of $V_{out}$ is zero thereby indicating that the amount of ink, if any, remaining in the ink tank is insufficient to continue printing. At this point, the ink tank is either refilled or replaced with another ink tank of similar design.

Using the discrete ink level sensing design as illustrated in FIG. 7, it can be seen that any number of discrete ink levels can be accommodated by selecting the number of conductors. In addition, it is also possible that the entire length of any one of the ink conductors need not be exposed to ink but only that the terminating ends or portions of each of the conductors be exposed to the ink to thereby provide a current carrying mechanism or contact area for the circuit. For additional information regarding ink detecting, refer to U.S. patent Ser. No. 08/570,299 having the title "Ink Detecting Mechanism for a Liquid Ink Printer," having a filing date of Dec. 11, 1995, assigned to the present assignee, herein incorporated by reference.

In recapitulation, there has been described an ink status system for a liquid ink printer. It is, therefore, apparent that there has been provided in accordance with the present invention, an ink status system which can generate a continuously variable signal as a function of a decreasing portion of a conductor contained within an ink tank or cartridge that fully satisfies the aims and advantages hereinbefore set forth. While this invention has been described in conjunction with a specific embodiment thereof, it is evident that many alternatives, modifications, and variations will be apparent to those skilled in the art. The present invention is not limited to the sensing of ink but applies equally to any conductive liquid. In addition, the present invention can be used to sense different colors and types of inks having different conductivities associated therewith. For instance, due to the sensitivity of the present invention and knowing the conductivities of the inks being used, which usually vary with respect to ink types or colors, a signal generated by the present invention could be used to indicate the use of proper colors or types of inks. Accordingly, it is intended to embrace all such alternatives, modifications and variations that fall within the spirit and broad scope of the appended claims.

What is claimed is:

1. A liquid ink printer, comprising:

an ink container having a first and second rigid, non-collapsible walls and adapted to hold a consumable supply of ink, the ink having a conductivity, the first and second walls being spaced apart and having confronting surfaces;

a first resistive conductor being disposed on and in direct contact with said surface of the first wall of the ink container;

a second resistive conductor being disposed on and in direct contact with said surface of the second wall of the ink container;

the first and second resistive conductors being substantially parallel with each other and being aligned with respective surfaces of the first and second walls such that depletion of the consumable supply of ink causes the ink to contact a decreasing portion of said first and second resistive conductors during consumption of the ink by the printer;

an ink sensing circuit coupled to said first and second resistive conductors for passing electrical current through the consumable supply of ink and sensing the ink conductivity thereof, the ink sensing circuit generating a continuously variable ink signal as a function of the decreasing portion of said first and second resistive conductors being contacted by the consumable supply of ink during consumption thereof, said electric current being sufficiently low to minimize compositional change of the ink; and a printhead, coupled to said ink container, for depositing ink received from said ink container.

2. The liquid ink printer of claim 1, wherein said ink sensing circuit comprises a high gain transistor circuit generating continuously variable signal in response to a current signal conducted through the ink.

3. The liquid ink printer of claim 2, wherein the current signal conducted through the ink produces a minimal compositional change throughout the lifetime of the ink supply.

4. The liquid ink printer of claim 3, wherein the minimal compositional change is approximately $10^{-6}$ moles per year.

5. The liquid ink printer of claim 3, wherein said high gain transistor circuit comprises a Darlington pair configuration circuit.

6. The liquid ink printer of claim 3, wherein said high gain transistor circuit comprises a hybrid-mode high-gain lateral bipolar junction transistor.

7. The liquid ink printer of claim 1, wherein said first and second resistive conductors are formed by laser fusing graphitic fibers embedded in said respective surfaces of the first and second walls of the ink container.

8. The liquid ink printer of claim 1, wherein said ink jet printhead comprises an ink ejecting transducer formed on a silicon wafer.

9. The liquid ink printer of claim 8, wherein said ink sensing circuit comprises a high gain transistor circuit formed on said silicon wafer.

10. The liquid ink printer of claim 9, wherein said high gain transistor circuit comprises a hybrid-mode lateral bipolar junction transistor.

11. The liquid ink printer of claim 1, wherein said continuously variable ink signal comprises a signal being determined as a function of a dimension of said first and second resistive conductors and as a function of a distance between said first resistive conductor and said second resistive conductor.

12. An ink status system for determining the status of a consumable supply of ink contained in an ink jet printer, comprising:

an ink container having a first and second rigid, non-collapsible walls and adapted to hold a consumable supply of ink the ink having a conductivity, the first and second walls being spaced apart and having confronting surfaces;

a first resistive conductor being disposed on and in direct contact with said surface of the first wall of the ink container;

a second resistive conductor being disposed on and in direct contact with said surface of the second wall of the ink container;

the first and second resistive conductors being substantially parallel with each other and being aligned with respective surfaces of the first and second walls such that depletion of the consumable supply of ink causes the ink to contact a decreasing portion of said first and second resistive conductors during consumption of the ink by the printer;

an ink sensing circuit coupled to said first and second resistive conductors for passing electrical current through the consumable supply of ink and sensing the ink conductivity thereof, the ink sensing circuit generating a continuously variable ink signal as a function of the decreasing portion of said first and second resistive conductors being contacted by the consumable supply of ink during consumption thereof, said electric current being sufficiently low to minimize compositional change of the ink; and a printhead, coupled to said ink container, for depositing ink received from said ink container.

13. The ink status system of claim 12, wherein said ink sensing circuit comprises a high gain transistor circuit generating the continuously variable signal in response to a current signal conducted through the ink.

14. The ink status system of claim 13, wherein the current signal conducted through the ink produces a minimal compositional change throughout the lifetime of the ink supply.

15. The ink status system of claim 14, wherein the minimial compositional change is approximately $10^{-6}$ moles per year.

16. The ink status system of claim 15, wherein said high gain transistor circuit comprises a Darlington pair configuration circuit.

17. The ink status system of claim 15, wherein said high gain transistor circuit comprises a hybrid-mode high-gain lateral bipolar junction transistor.

18. The ink status system of claim 12, wherein said first and second resistive conductors are formed by laser fusing graphitic fibers embedded in said respective surfaces of the first and second walls of the ink container.

19. The ink status system of claim 12, wherein said continuously variable ink signal comprises a signal being determined as a function of a dimension of said first and second resistive conductors and as a function of a distance between said first resistive conductor and said second resistive conductor.

* * * * *